United States Patent [19]

Fowler et al.

[11] Patent Number: 4,794,833

[45] Date of Patent: Jan. 3, 1989

[54] METHOD AND APPARATUS FOR MONOLAYERING OF WAFERS

[75] Inventors: David P. Fowler, Irving; Daniel A. Asquino, Lewisville; Ramon Cantu, Dallas, all of Tex.

[73] Assignee: Frito-Lay, Inc., Dallas, Tex.

[21] Appl. No.: 713,896

[22] Filed: Mar. 20, 1985

Related U.S. Application Data

[63] Continuation-in-part of Ser. No. 544,971, Oct. 24, 1983, abandoned.

[51] Int. Cl.[4] ..... B26D 7/18; B26D 7/32

[52] U.S. Cl. ..... 83/24; 83/26; 83/27; 83/99; 83/155; 83/165; 83/403; 83/404.3

[58] Field of Search ..... 83/24, 98, 99, 110, 83/111, 403, 404.3, 417, 703, 26, 27, 155, 165; 406/123, 153; 198/399, 447

[56] References Cited

U.S. PATENT DOCUMENTS

| | | | |
|---|---|---|---|
| 2,148,922 | 2/1939 | Bachofner | 146/93 |
| 3,139,129 | 6/1964 | Urschel et al. | 146/241 |
| 3,239,278 | 3/1966 | Mueller et al. | 302/51 |
| 3,944,062 | 3/1976 | Keller | 198/220 BA |
| 4,251,555 | 2/1981 | Kroenig | 426/231 |

FOREIGN PATENT DOCUMENTS

| | | | |
|---|---|---|---|
| 895839 | 1/1982 | U.S.S.R. | 406/153 |
| 2035244 | 6/1980 | United Kingdom . | |

*Primary Examiner*—Frank T. Yost
*Assistant Examiner*—Hien H. Phan
*Attorney, Agent, or Firm*—Bernard, Rothwell & Brown

[57] ABSTRACT

A method and apparatus for monolayering sliced wafer-like articles such as fruit or vegetable slices to enhance further product processing. The apparatus includes a slice catcher in cooperative relationship with a centrifugal slicer such that discharged product slices impinge onto the slice catcher inner surface and are captured by a flow of liquid passing over the slice catcher inner surface. The slices are controllably separated, conveyed and deposited in monolayered fashion on a conveyor for subsequent processing.

20 Claims, 5 Drawing Sheets

METHOD AND APPARATUS FOR MONOLAYERING OF WAFERS

BACKGROUND OF THE INVENTION

Cross-Reference to Related Application

This is a continuation-in-part of co-pending U.S. patent application Ser. No. 544,971, filed Oct. 24, 1983, now abandoned.

FIELD OF THE INVENTION

This invention relates to improvements in a method and apparatus for monolayering wafer-like articles, particularly slices of potatoes, apples or the like.

BACKGROUND ART

In the manufacture of apple chips, whole apples are sliced in a commercially available centrifugal slicer and further processed through various stages, e.g., the commonly owned application of Glass et al., Ser. No. 484,488, filed Apr. 13, 1983, now U.S. Pat. No. 4,214,428. Also in the conventional manufacture of potato chips, potatoes are sliced in a similar commercially available slicer and then are further processed through frying, seasoning and packaging. In both of these processes, and others involving sliced fruit or vegetables, it is often necessary to arrange the slices in a single layer without overlap (called a "monolayer") for subsequent processing, drying, and/or seasoning steps. However, with slices exiting from a centrifugal slicer around the periphery thereof and more or less at random it has been a difficult and thought-to-be impossible task to provide an orderly monolayer of such vegetable or fruit slices. The random commingling of slices makes their organization into a monolayered arrangement a problem of great physical complexity. The complexity increases (perhaps exponentially) as slice rate increases.

SUMMARY OF THE INVENTION

This invention provides a method and apparatus for monolayering and maintaining separate individual slices as they exit a multi-station, centrifugal, rotary slicing machine by first immediately catching slices after they are centrifugally discharged from the slicing machine and controllably moving the caught slices vertically downward in a fluid stream and at the same time maintaining each of such slices separate from one another, and depositing the separated slices in separate rows on a moving take-out conveyor.

Two separate embodiments of apparatus are disclosed. In one embodiment the centrifugal slicer is completely surrounded by a cylindrical slice catcher which is washed by a wall of fluid such as water. Slices are directed downwardly and then outwardly into separate guide paths from which they are deposited onto the moving conveyor. In the other embodiment, individual vertical tubular slice catchers are positioned adjacent the outlets of the centrifugal slicer to catch the slices where they are moved vertically downwardly in a wall of water in individual tubes having their exit ends directed to the conveyor so as to place the slices from the individual tubes in separate rows on the take-out conveyor.

DETAILED DESCRIPTION OF THE PREFERRED EMBODIMENT

Figure 1:
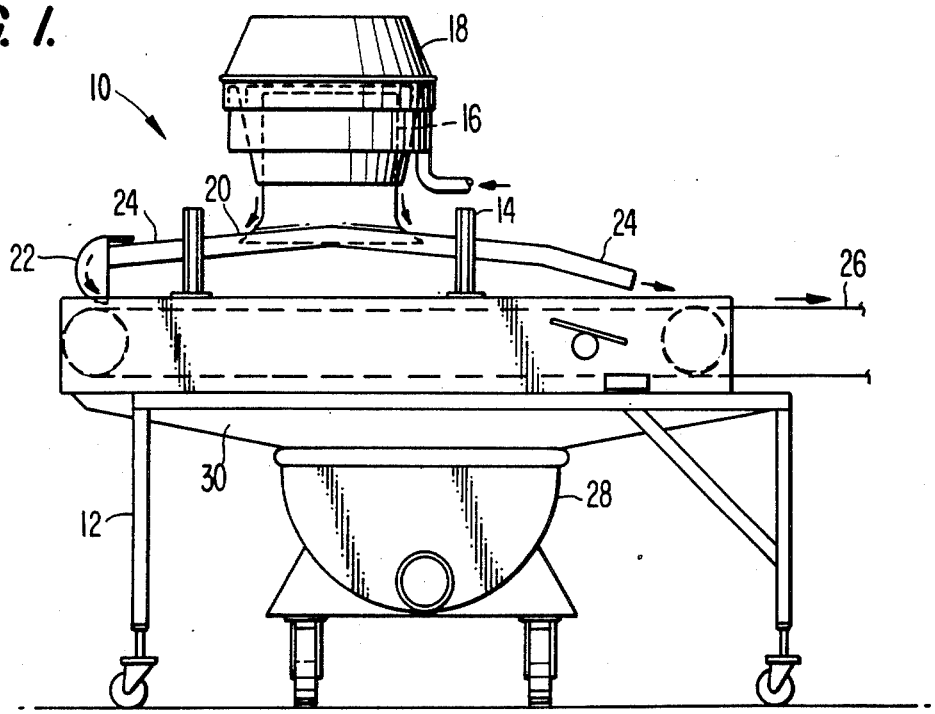
FIG. 1 is a side elevation of a monolayering apparatus of this invention shown with a cylindrical slice catcher and associated components.
Figure 2:
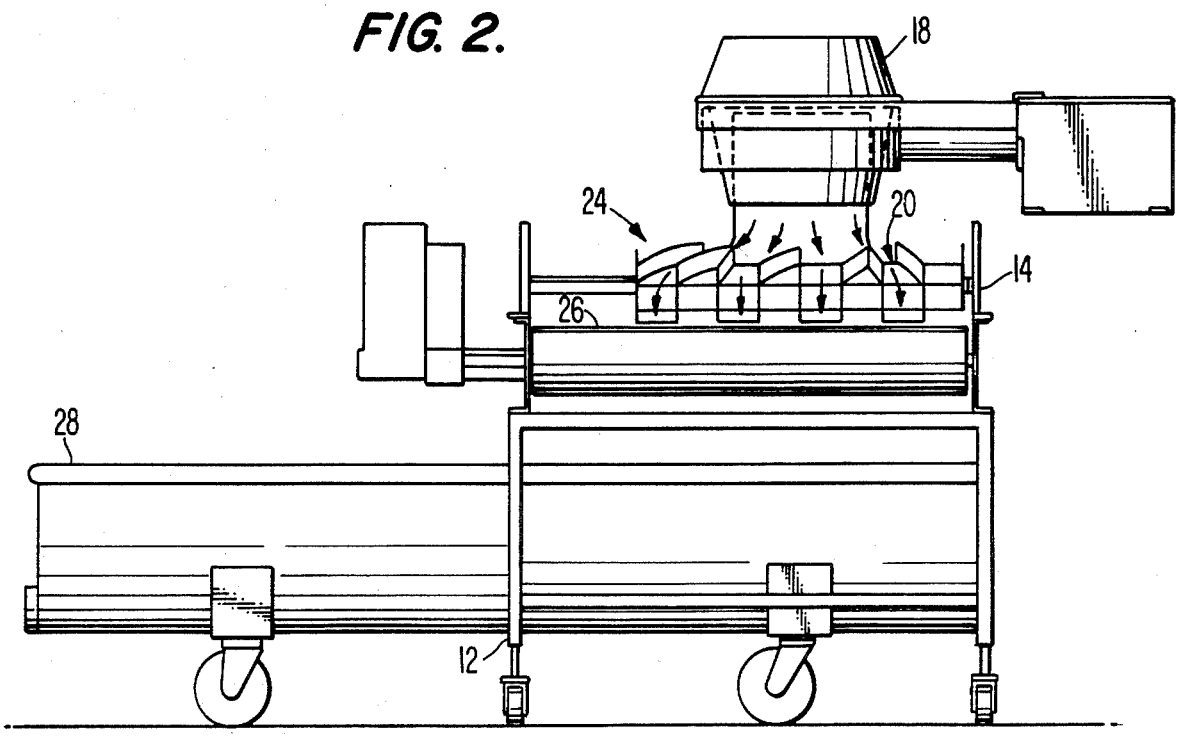
FIG. 2 is a front elevation of a monolayering apparatus of this invention showing separate guide paths associated with a cylindrical slice catcher.

In accordance with the present invention, fruit or vegetable slices are monolayered by capturing the slices in the serial sequence in which they are produced from a slicer knife station and maintaining this sequence until the slices are deposited in single file on a continuously moving horizontal conveyor belt.

Referring to the drawings, an apparatus 10 is provided with a supporting framework 12 including a mounting assembly 14 for supporting a conventional commercial centrifugal slicer 16, e.g., an Urschel slicer which is completely surrounded by a cylindrical slice catcher 18 in communication with separate guide paths 20 having optional curved or concave deflection elements 22 at one end thereof.

A flat wire metal belting or other suitable open construction conveyor 26 is positioned intermediate bifurcated sluice 24 and an elongated fluid recirculating tank or trough 28 including declinated draining surface 30 for returning process fluid to the system. Sliced product such as potato or apple chips C in wafer-like configuration (see FIGS. 3 and 4) produced by centrifugal slicer 16 impinge a cylindrical wall stop 32 of the slice catcher 18 where they are stopped and caught and controllably moved vertically downwardly by a fluid F such as water flowing into guide paths 20 of sluice 24 and onto conveyor 26 for subsequent treatment downstream.

The purpose of the apparatus of this invention and the method disclosed herein is to catch the individual slices as they exit the slicer and keep them separate while they are routed to and monolayered on the conveyor. Since Urschel centrifugal slicers have several (eight is standard) knife stations, a row of slices on the moving conveyor belt will be produced for each knife station in the slicing machine. The result is a multiplicity of parallel rows of non-overlapping slices aligned in the direction of the conveyor belt travel. This is accomplished by providing fast-moving liquid curtains to flush the surfaces on which the fast-moving slices impact after they exit the knife stations.

Figure 3:
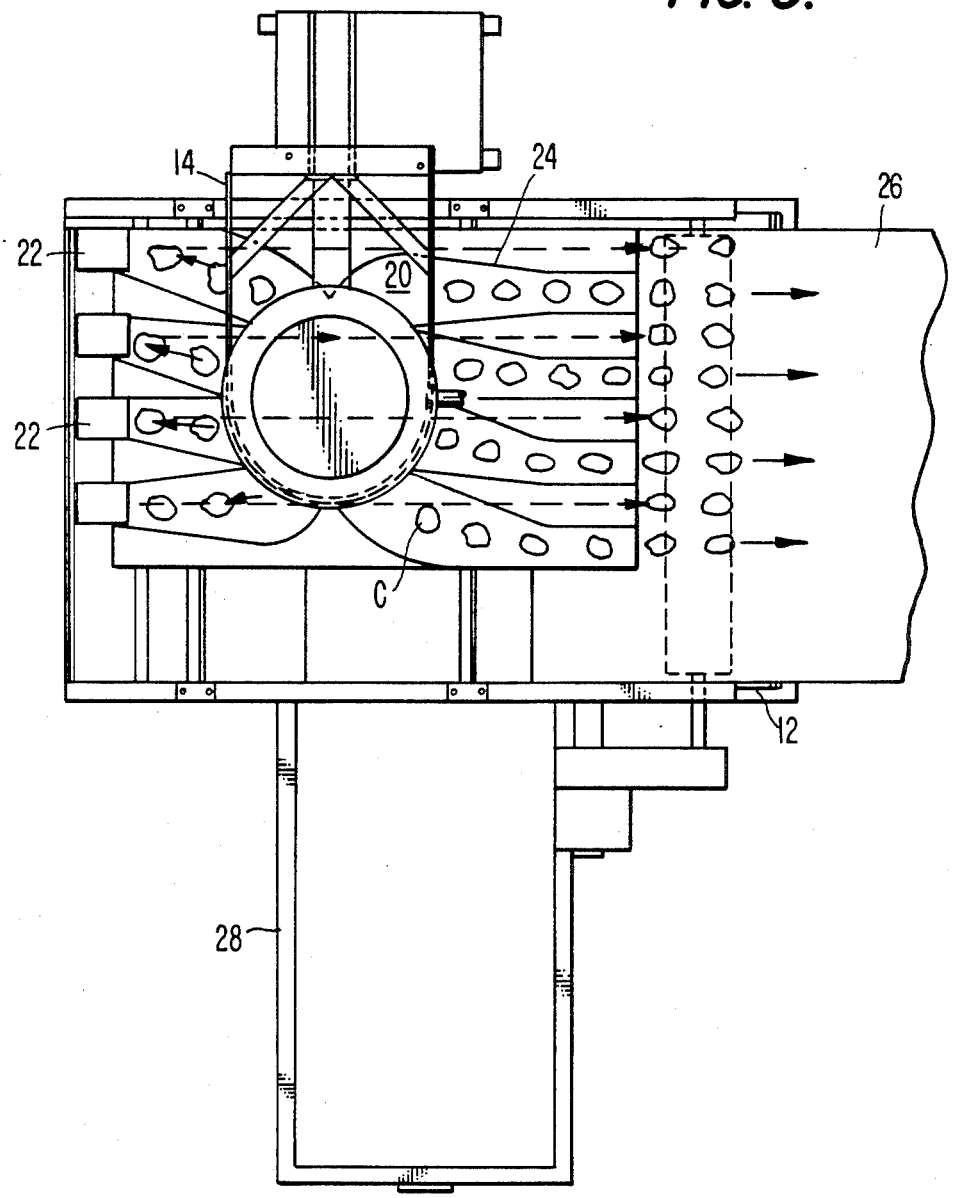
FIG. 3 is a top plan view of the monolayering apparatus of FIG. 1, including the centrifugal slicer, separate guide paths and conveyor.
Figure 4:
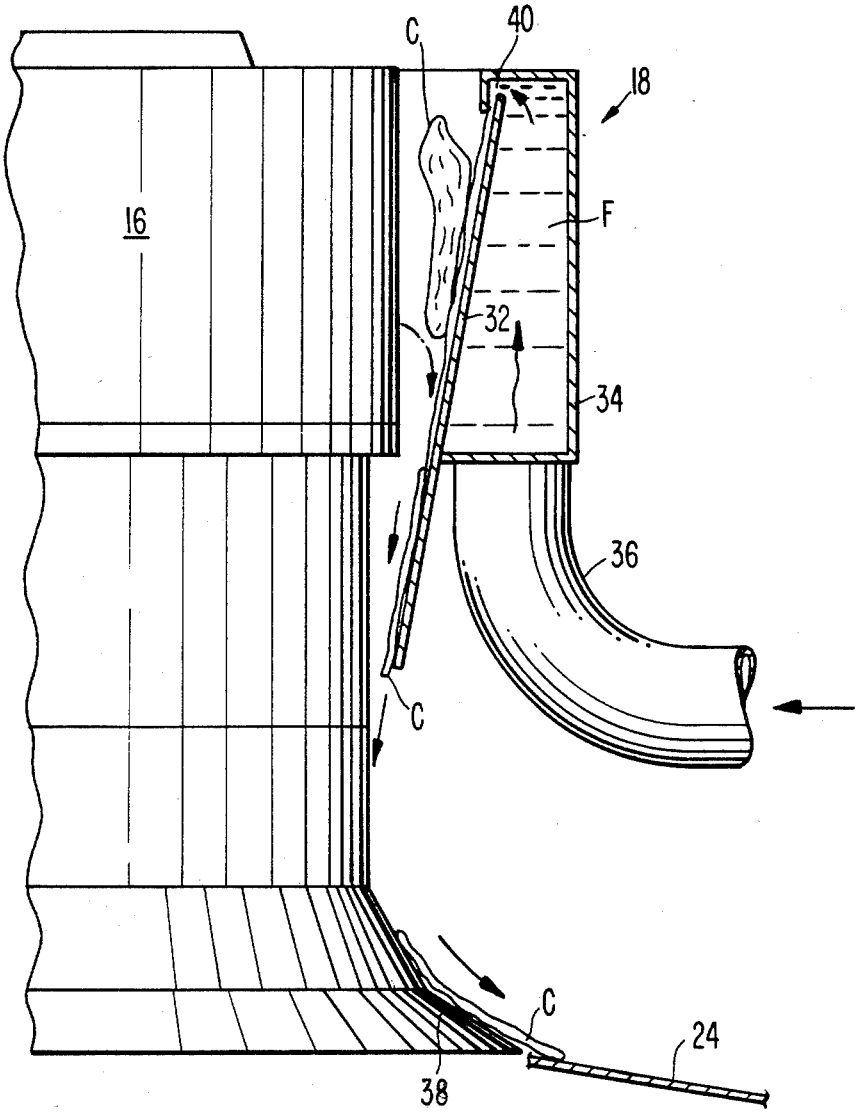
FIG. 4 is a partial side elevation partially in section showing the cylindrical slice catcher of FIG. 1 in more detail.

As shown in FIG. 4, the cylindrical slice catcher 18 includes a fluid chamber 34 and a fluid inlet 36. An outlet 40 is provided to allow fluid in chamber 34 to flow downwardly under pressure and increased velocity over wall surface 32 as indicated by the arrows and wash the chips C into the separate guide paths 20 in bifurcated sluice 24. As shown in FIGS. 3 and 4 the entrances to the legs of the sluice 24 surround the periphery of a base flaring 38 below the slicer 16. The outlets of the sluice legs are spaced apart as shown in FIG. 3 so that when the chips in the legs with deflectors 22 are positioned on the conveyor 26 they will be in a position between chips exiting from the other legs of the sluice. The chips C are thus deposited on the conveyor 16 in spaced parallel rows without any overlapping of chips, i.e. the chips are monolayered.

FIGS. 5–8 illustrate a second embodiment of the monolayering apparatus having a plurality of stationary (but adjustable) generally tubular slice catchers 42 positioned in-line with the slots or openings (not shown) of the centrifugal slicer through which exit the individual slices of the sliced product.

Figure 5:
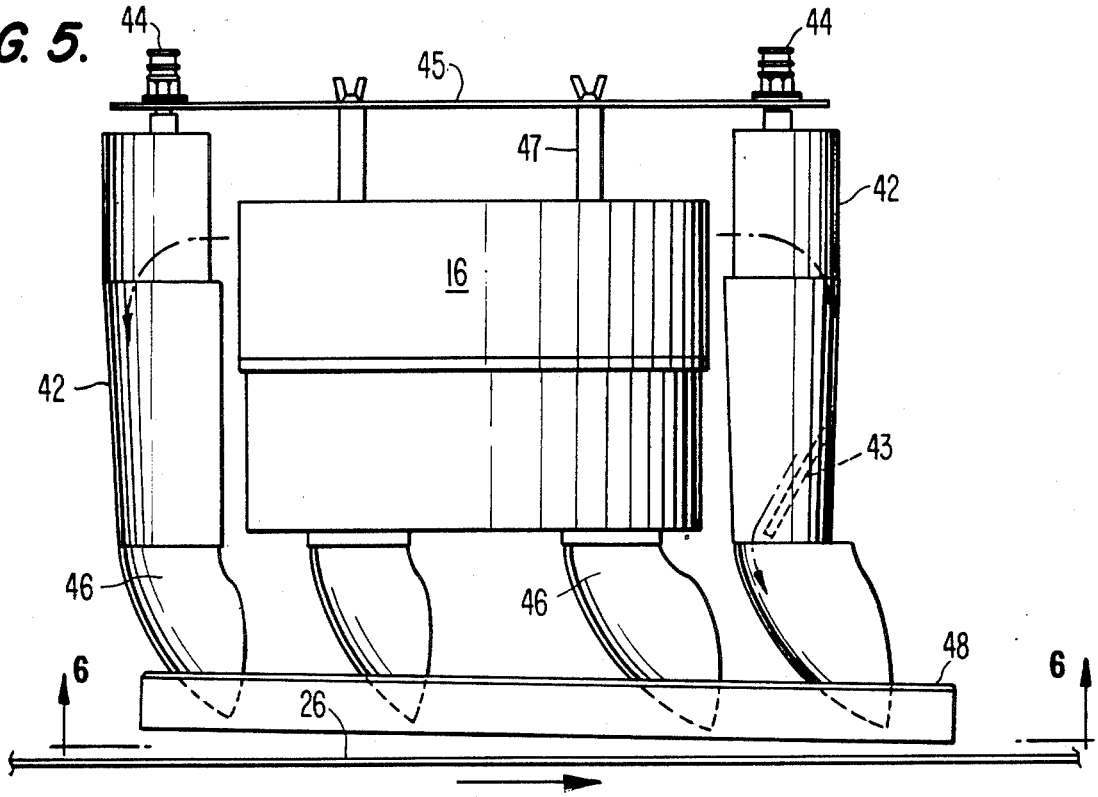
FIG. 5 is a side elevation of another embodiment of the monolayering apparatus showing individual vertical tubular slice catchers and associated components.
Figure 6:
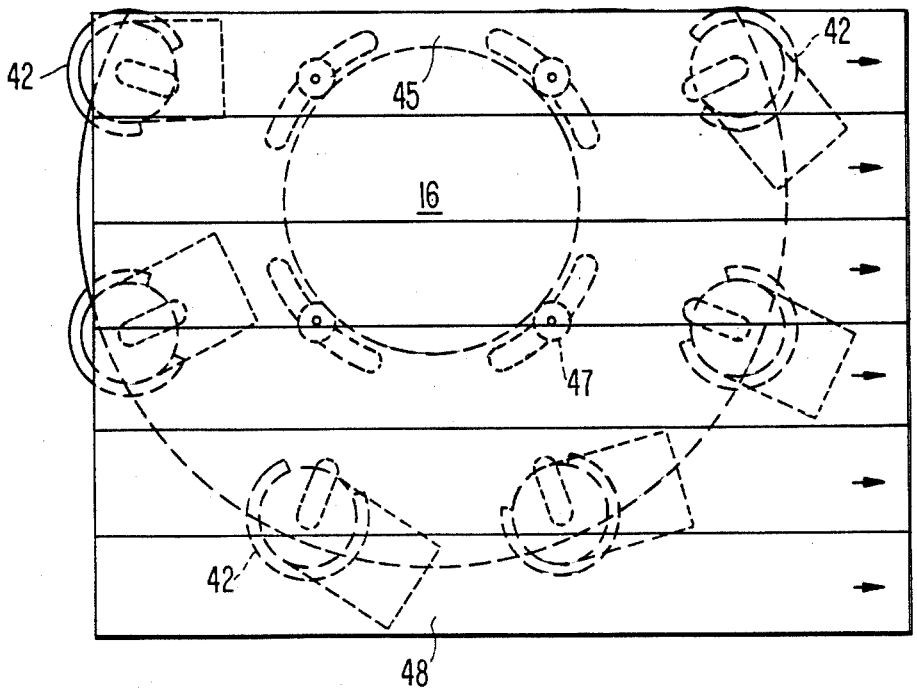
FIG. 6 is a bottom plan view of the monolayering apparatus taken along line 6—6 of FIG. 5.
Figure 8:
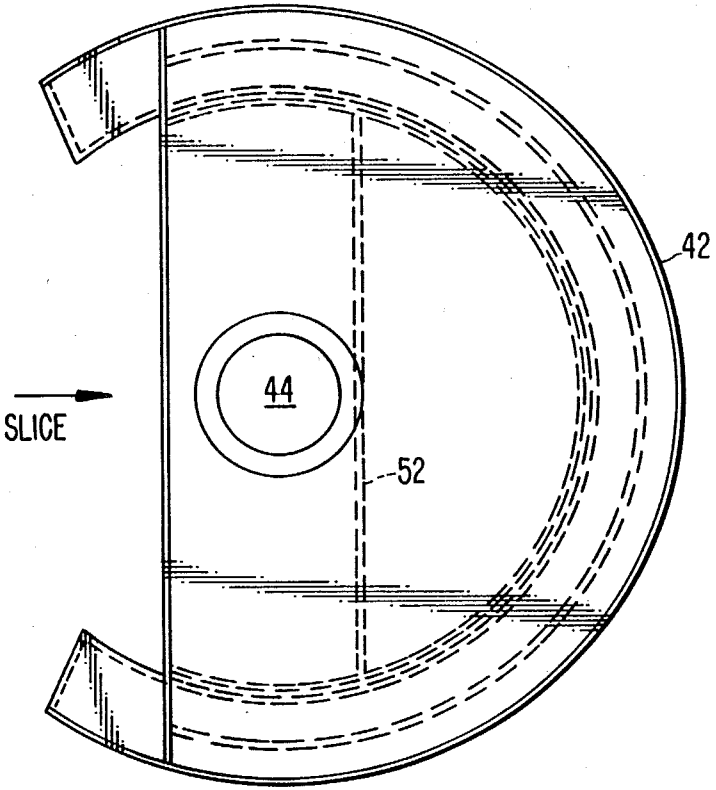
FIG. 8 is a top plan view of the individual vertical tubular slice catcher of FIG. 7.

As shown in FIGS. 5 and 6, the individual frustoconical slice catchers 42 are supported from a support plate 45 adjustably attached to the slicer 16 by connection 47. The slice catchers are positioned around the periphery of slicer 16 and include a fluid inlet 44 for introducing fluid onto the inner surface thereof and an adjustable discharge nozzle 46 for selectively directing the flow of fluid and sliced product into equally spaced, parallel rows onto the conveyor 26. The outlet direction of each discharge nozzle 46 is adjustable by hand rotation about the area of attachment of the nozzle to the slice catcher 22. Such adjustment can position each outlet so that slices exiting from them will be in parallel rows and will not overlap. In addition, an arrangement of separate box-like sluice channels 48 may be provided, if necessary, in cooperative association with each nozzle 46 to insure that the separate individual slices are guided onto the conveyor in horizontal, monolayered fashion.

Slice deflectors 43 may be positioned within slice catchers 42 to direct the slices and their associated carrier liquid towards the inside back portion of discharge nozzles 46.

The surfaces of the slice-contacting portions of the slice catchers 42, deflectors 43 and discharge nozzles 46 are preferably provided with a non-stick coating such as Teflon to minimize friction.

Figure 7:
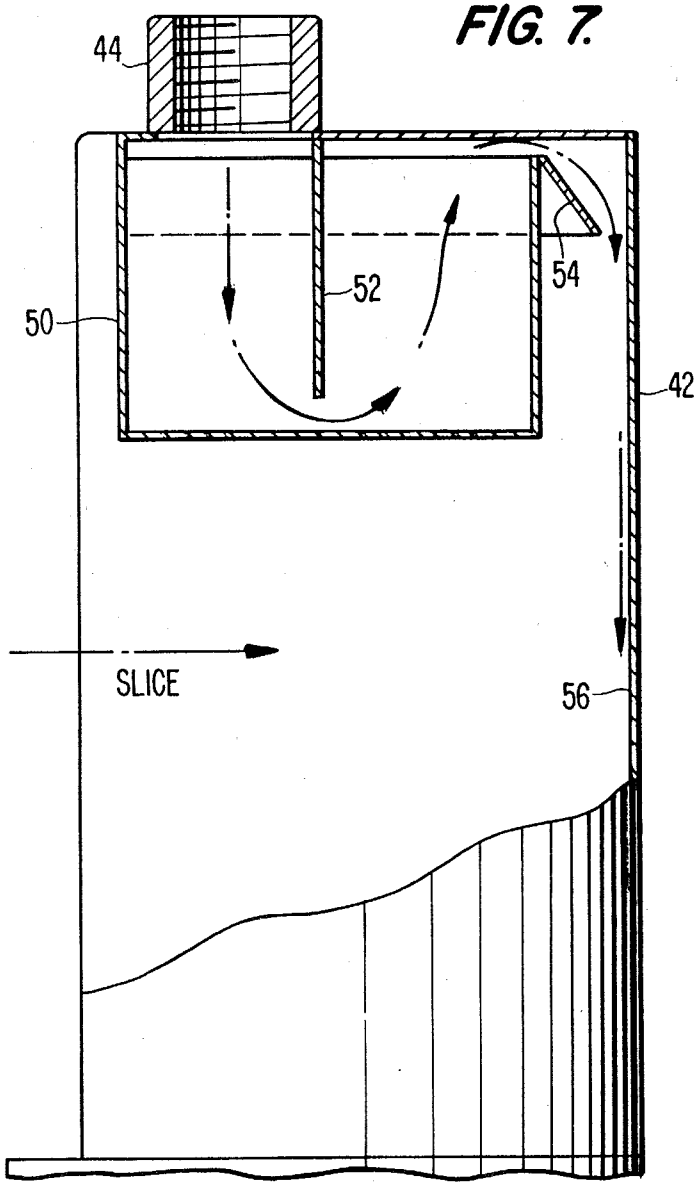
FIG. 7 is a partial sectional view of an individual vertical tubular slice catcher as shown in FIG. 5.

Each slice catcher, as shown in FIG. 7, has its individual fluid inlet 44 for the introduction of fluid (liquid) under pressure into a chamber 50 having a baffle 52, and an angled lip or flange 54 to direct the flow of liquid through the chamber 50 and onto an inner surface 56 of the slice catcher as indicated by the arrows.

Referring once again to FIGS. 1–4, an operation of the apparatus and description of the method is as follows:

Vegetable or fruit slices or chips C exit from slots in the periphery of a rotary centrifugal slicer (e.g. Model CC (flat) or Model CCL Lattice Slicer manufactured by Urschel Laboratories, Inc., Valparaiso, Ind. 46383) and impinge upon generally vertical surface 38 of stop 32. The vertical surface is continuously flushed with a high velocity liquid F (preferably water) from fluid outlet 40. Each slice is carried away from the impact area by the moving liquid before the succeeding slice impacts. The liquid velocity is made great enough to maintain some physical separation between consecutive slices. Liquid F generally has a greater downward velocity than the velocity of the slices or chips C so that sequential separation of the chips is maintained. The individual chips from each slicing area of the centrifugal slicer are carried downwardly along surface 38 of stop 32 by the fluid flow which carries and directs the chips onto a guide path or leg 20 of bifurcated multichanneled sluice 24.

As best seen in FIG. 3, some of the guide paths 20 of sluice 24 may be provided with curved deflection elements 22 which "catch" and reverse the direction of the slices or chips and carrier liquid so that all slices and liquid have a common horizontal direction. The flushing or carrier liquid serves to maintain adequate velocity for sequential separation and as a conveying vehicle until the slices are deposited on conveyor 26.

As previously noted, conveyor 26 is of open construction (e.g., flat wire metal belting) which allows the carrier fluid to drain by way of surface 30 into trough 28 for recirculation and reuse in the system.

The linear speed of the continuously moving conveyor belt 26 may be adjusted to provide the packing density on the belt of the slices being transported by the fast-moving liquid stream. By carefully adjusting the belt speed in accordance with the slicing rate, the optimum non-overlapping (monolayered) serial arrangement can be made. In general, it is preferable that the slices be deposited onto the belt 26 somewhat closer to each other (in the direction of travel) than when in the liquid transport mode. This may be achieved when using an Urschel rotary slicer by adjusting the speed of the conveyor to a slower (lesser) velocity than the velocity of the slices or chips within liquid vehicle carrier. The sliced product is then deposited on the conveyor in generally equally spaced parallel rows in which there is essentially no overlapping of slices or chips either side-to-side or end-to-end. In other words, the sliced product is organized in horizontal, monolayered fashion which facilitates subsequent processing, drying and/or seasoning steps.

In the alternative embodiment shown in FIGS. 5–8, individual partially open vertical tubular slice catchers or tubes 42 are positioned adjacent the outlets of the centrifugal slicer 16. As shown in FIG. 5, each catcher 42 is provided with a fluid inlet 44 and an adjustable discharge nozzle 46. A sluice 48 may be provided to insure that the product slices and carrier fluid are directed onto conveyor 26 in individual, equally spaced parallel rows.

As with the prior embodiment, the flushing or carrier liquid serves to maintain adequate velocity for sequential separation of the slices or chips as they exit the centrifugal slicer 16, and convey the sliced product until deposited on conveyor 26.

In FIG. 7, the internal configuration of the fluid receptacle or chamber 50 is depicted. As fluid enters and fills the chamber through inlet 44, baffle 52 extending downwardly from the inner top surface of the chamber and angular lip 54 are positioned to provide a constant flow of fluid under pressure over surface 56 having a velocity in excess of that of the sliced product exiting slicer 16. Flange or lip 54 insures that fluid will flow continuously down inner wall or surface 56 upon which the sliced products impinge. As the chips or slices are carried downwardly along the inner surface 56 and into adjustable discharge nozzle 46, box-like sluice channels 48 as shown in FIGS. 5 and 6, arrange the moving slices into equally spaced parallel monolayered rows on conveyor 26.

Whereas this invention is illustrated and described with specific reference to embodiments presently contemplated as the best mode of carrying out the invention in actual practice, it is to be understood that various changes may be made to different embodiments without departing from the broader inventive concepts disclosed and claimed herein.

What is claimed is:

1. A method of monolayering slices having large, generally parallel and generally planar faces exiting from a rotary centrifugal slicing machine, comprising:

(a) providing a slice catcher having first and second end portions, the first end portion including a generally vertically stop surface, over which is flowing a downwardly moving stream of liquid, in position so that individual slices exiting the periphery of the slicing machine immediately impinge on said vertical surface in said downwardly moving stream of liquid;

(b) separately catching each individual slice at said stop surface in said downwardly moving stream of liquid immediately upon each slice exiting form the periphery of the rotary slicing machine;

(c) directing each individual cut slice downwardly in the moving stream of liquid on said slice catcher, with each individual slice separate from the other;

(d) maintaining the downwardly moving slices separated and positioned in a plurality of separate rows from the first end portion past the second end portion to a moving take-out conveyor belt; and (e) depositing the separate rows of separated slices on the moving take-out conveyor belt so that the individual slices are monolayered on the belt and the planar faces of the slices do not overlap one another.

2. A method of monolayering slices having large generally parallel and generally planar faces exiting from a rotary centrifugal slicing machine, the method comprising:

(a) providing a slice catcher having first and second end portions, (b) separately catching each individual slice at said first end portion, immediately upon each such slice exiting from the periphery of a rotary centrifugal slicing machine, (c) directing each individual caught slice downwardly in a stream of liquid on said slice catcher, with each individual slice separate from the other, (d) maintaining the downwardly moving slices separated and positioned in a plurality of separate rows from the first end portion past the second end portion to a moving take-out conveyor belt, and (e) depositing the separate rows of separated slices on a moving take-out conveyor belt so that the individual slices are monolayered on the belt and the large planar faces of the slices do not overlap one another.

3. A method according to claim 2, wherein said downwardly moving liquid stream has a greater velocity than a horizontal velocity of the slices exiting from the centrifugal slicing machine and said conveyor is moving at a velocity different than the velocity of the slices in the liquid stream in order to maintain the individual slices separated from one another.

4. The method of claim 3 wherein the conveyor is moving at a velocity less than the velocity of the slices in the liquid stream.

5. Apparatus for monolayering slices exiting from a rotary centrifugal slicer, comprising:

(a) a slice catcher comprising first and second end portions, the first end portion including a stop adjacent said first end portion having a surface positioned in the path of the slices for separately capturing individual slices as they exit from cutting slots in the periphery of the rotary centrifugal slicer;

(b) means for providing a downwardly moving stream of liquid flowing over the stop surface so that slices are captured in the downwardly moving stream of liquid to separate and controllably move individual slices captured by the slice stop downwardly from the slicer;

(c) a moving take-out conveyor belt, (d) means for maintaining slices separated and moving downwardly from the slicer in separate rows from the stop past the second end portion to the moving conveyor belt; and (e) means for depositing in a monolayer the separate rows of separated slices on the moving take-out conveyor belt.

6. Apparatus for monolayering slices or sliced chips exiting from a rotary centrifugal slicer, the apparatus comprising:

(a) a slice catcher comprising first and second end portions, the first end portion including a stop adjacent said first end portion positioned in the path of the slices for individually and separately capturing same as they exit from cutting slots in the periphery of the rotary centrifugal slicer, (b) means for directing liquid under pressure to assist in separating and controllably moving said slices captured by the slice stop downwardly from the slicer, (c) a moving take-out conveyor belt, (d) means for maintaining slices separated and moving downwardly from the slicer in separate rows, from the stop past the second end portion to the moving conveyor belt, and (e) means for depositing the separate rows of separated slices in a monolayer on the moving take-out conveyor belt.

7. Apparatus as in claim 6 wherein the catcher includes a fluid chamber and a fluid inlet wherein an inclined outer wall of said stop and said chamber form a fluid outlet for directing fluid flow downwardly under pressure and increased velocity over a surface of said stop for capturing said slices.

8. Apparatus as in claim 6 wherein the stop includes a frusto-conical wall.

9. Apparatus as in claim 8 wherein said liquid is in the form of a stream of liquid that flushes the entire frusto-conical wall.

10. Apparatus as in claim 8 wherein said frusto-conical wall is inclined away from said slicer.

11. Apparatus as in claim 10 wherein said frusto-conical wall surrounds said slicer.

12. Apparatus as in claim 6 wherein the means for maintaining these slices in separate rows includes a bifurcated multichanneled sluice having a number of paths extending in opposite directions from an axis of the slicer.

13. Apparatus as in claim 12 wherein the number of paths extend in opposite directions from the axis of the slicer and at least one of said paths has a curved deflection element attached thereto.

14. Apparatus as in claim 6 wherein said stop comprises a plurality of generally vertical partially open tubes.

15. Apparatus as in claim 14 wherein means for directing liquid under pressure to assist in separating and controllably moving the slices comprises:

(a) a fluid chamber, (b) a fluid inlet in communication with said chamber, (c) means for directing the flow of fluid through said chamber.

16. Apparatus as in claim 15 wherein said means for directing the flow of liquid through said chamber comprises a baffle attached to and extending vertically downwardly from the inner top surface of said chamber to a position proximate the bottom of said chamber.

17. Apparatus as in claim 15 wherein said means for directing liquid under pressure comprises an angular lip positioned to provide a constant flow of fluid under pressure downwardly over an inner surface of said catchers.

18. Apparatus according to claim 15 wherein said tubes further include adjustable nozzles.

19. The apparatus of claim 18 wherein said tubes further include slice deflectors to direct slices and liquid towards an inside back portion of the nozzles.

20. Apparatus according to claim 15 wherein said tubes are provided with sluice channels to insure that the slices and liquid are directed onto said conveyor in separated, individually spaced parallel rows.

* * * * *